United States Patent [19]

Blanchard

[11] Patent Number: 4,729,498

[45] Date of Patent: Mar. 8, 1988

[54] TELESCOPIC GARMENT HANGER

[75] Inventor: Russell O. Blanchard, Zeeland, Mich.

[73] Assignee: Batts, Inc., Zeeland, Mich.

[21] Appl. No.: 28,151

[22] Filed: Mar. 26, 1987

[51] Int. Cl.[4] ..... A47G 25/44; A47G 25/62

[52] U.S. Cl. ..... 223/95; 223/63

[58] Field of Search ..... 223/89, 90, 94, 95, 223/96, 63, 74

[56] References Cited

U.S. PATENT DOCUMENTS

| | | | |
|---|---|---|---|
| 2,500,817 | 3/1950 | Glassmeyer | 223/89 |
| 2,828,897 | 4/1958 | Gordon | 223/95 |
| 2,919,839 | 1/1960 | Burns | 223/95 |
| 3,632,028 | 1/1972 | Fussel | 223/95 |
| 4,295,585 | 10/1981 | Garrison | 223/96 |

FOREIGN PATENT DOCUMENTS

| | | | |
|---|---|---|---|
| 34104 | 1/1965 | Finland | 223/95 |
| 224004 | 12/1968 | Sweden | 223/95 |
| 1189093 | 4/1970 | United Kingdom | 223/94 |

*Primary Examiner*—Robert R. Mackey

*Attorney, Agent, or Firm*—Price, Heneveld, Cooper, DeWitt & Litton

[57] ABSTRACT

A garment hanger for suspending garments from their waistband is provided with a hollow tubular beam-like body suspended from a hook at its center. A pair of end members are telescopically slidably seated, one in each end of the body. Each end member is individually urged into extended position by an elastic tension member which is anchored at the outer end of the body and operatively engages the inner of the end member. Preferably, the tension members are endless loops, the closed ends of each of which are hooked to the end of the body and at their centers are wrapped around the inner ends of the end members. The body and end members have interfitting flanges for guiding and stabilizing the end members.

13 Claims, 16 Drawing Figures

TELESCOPIC GARMENT HANGER

FIELD OF THE INVENTION

This invention relates to garment hangers of the type which engage the inside surface of the garment's waistband and have telescopic arms capable of automatic extension to grip the garment by a resilient force independently applied to each of the arms.

BACKGROUND OF THE INVENTION

The hanger of this invention is designed to support, for both transport and display, garments having a waistband, such as skirts, slacks, pants and the like. It is particularly designed for heavier garments which require a firm engagement between the hanger and the garment to assure sufficient grip to reliably support the weight of the garment under all normally expected transport and display conditions. Further, it is designed to have sufficient strength to be used with heavy garments such as winter weight clothing.

Various types of variable body length hangers for this purpose have been devised but have not proven to be entirely acceptable for a variety of reasons. Many of them have been difficult to apply and remove from the garment. To be readily useable, the hanger must be capable of manipulation by one hand since the operator's other hand must be available to handle the garments. This requirement necessitates a hanger design such that the operator can both support and contract the hanger with one hand.

It is also necessary that the hanger automatically center itself with respect to the garment. Unless the hanger accomplishes this, there is always the possibility that the hook supporting the hanger will be off center with respect to the garment and, thus, the garment and hanger will not hang straight, a very undesirable condition, particularly at the point of purchase.

It is also important that the hanger be light weight, not only for shipping purposes but also to facilitate their use by store and other personnel. In this connection, it is important to make their operation simple and free from structures which may fail or give difficulty while the hanger is being used. The hanger must be capable of withstanding a certain degree of abuse on the part of store personnel and customers without becoming inoperative. Despite these various requirements and others, the hanger must be relatively low cost and in many retail establishments expected to have reasonably long useful life.

BRIEF DESCRIPTION OF THE INVENTION

The invention provides a hanger having a main body of a hollow or tubular beam-like construction except that its lower face is almost entirely open. Telescopically mounted in each end of the beam is an extension arm. Each of the arms is independently biased into extended position by an elastic member. The beam and extension arms are so designed that they can be assembled together and the elastic member secured by the simple act of inserting an end of the arm into an open end of the hanger's main body. Upon release, the arms will automatically shift to full extended position and both arms can be simultaneously retracted by an operator with one hand using the hand grips provided on the arms for that purpose. The hand grips are also so designed that by means of them the operator can support and manipulate the hanger.

DESCRIPTION OF THE PREFERRED EMBODIMENT

Figure 1:
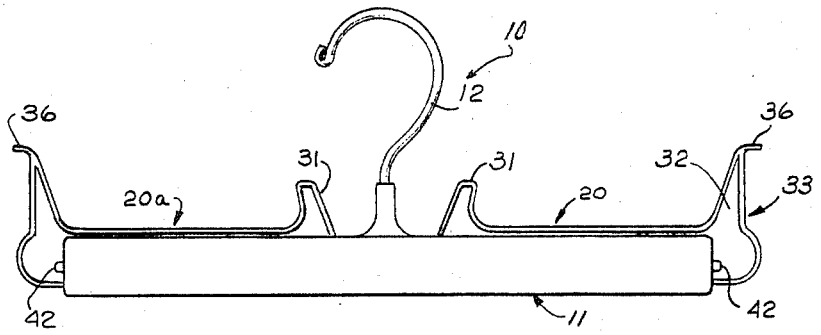
FIG. 1 is a side elevation view of a hanger incorporating this invention showing the hanger in contracted condition.
Figure 2:
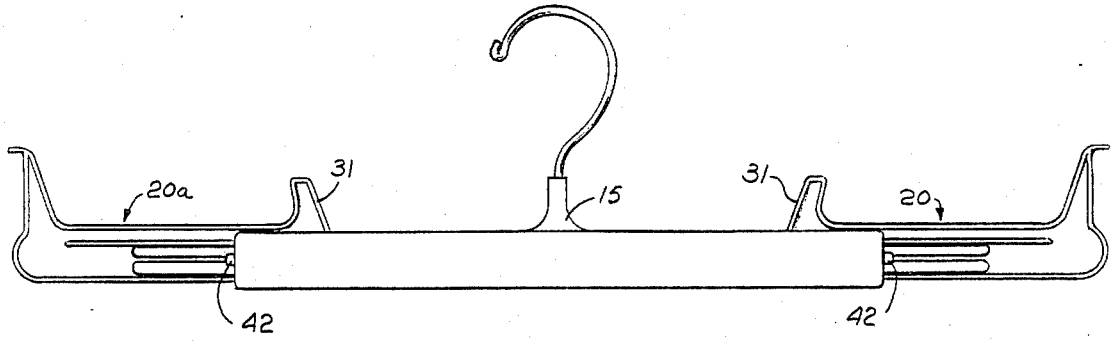
FIG. 2 is a view similar to FIG. 1 but showing the hanger extended.
Figure 3:
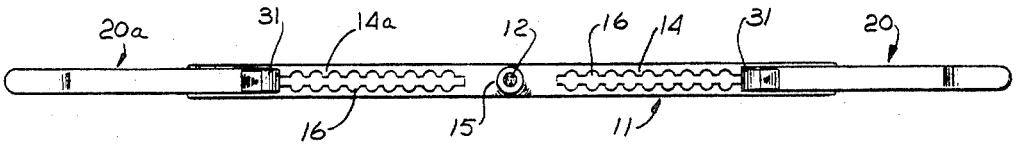
FIG. 3 is a top plan view of the hanger in extended condition.
Figure 8:
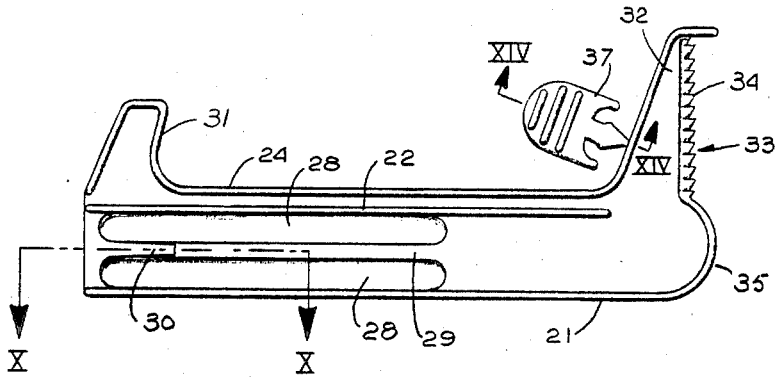
FIG. 8 is a side elevation view of one of the arms.

Referring to FIG. 1, the numeral 10 identifies a hanger having a main body member 11 supported at the center by a hook 12 and having a pair of end elements or slides 20 and 20a, one at each end. The main body 11 is a rigid elongated tubular beam of generally rectangular, cross-sectional shape. The top of the beam has central slots 14 and 14a extending from each end to a point adjacent the center where the sides of the beam are connected by the cross member and boss 15 (FIG. 3). The boss 15 mounts the hook 12. The slots 14 and 14a each have a plurality of equally spaced notches 16 which are widened areas to receive the hereinafter described stops (FIG. 8).

Figure 4:
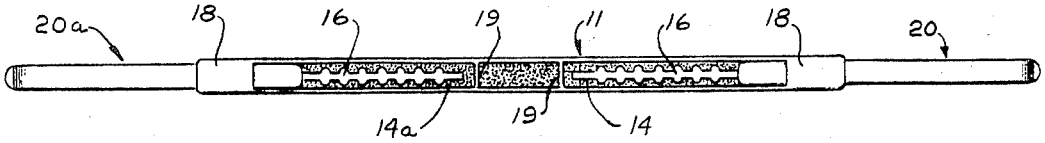
FIG. 4 is a bottom view of the hanger in extended condition.

The bottom face of the beam is open except for a pair of short panels 18, one at each end (FIG. 4). Beneath the cross member 15, the sides of the beam are connected by a pair of spaced webs 19 which brace and stiffen the sides.

Figure 9:
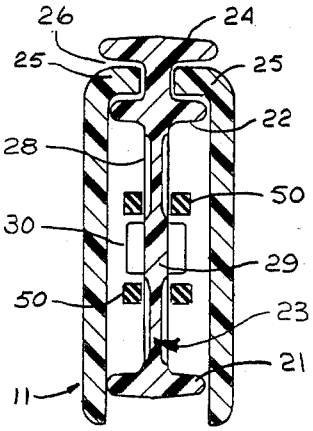
FIG. 9 is a sectional elevation view taken along the plane XI—XI of FIG. 6.
Figure 10:
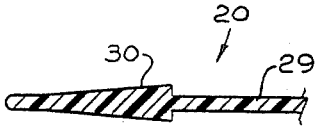
FIG. 10 is a fragmentary sectional view taken along the plane X—X of FIG. 8.
Figure 7:
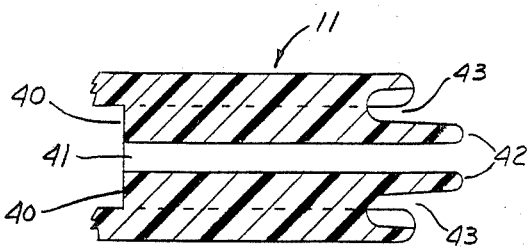
FIG. 7 is a fragmentary sectional view taken along the plane VII—VII of FIG. 11.

The end elements or slides 20 are designed to be telescopically mounted through the opposite ends of the beam. The slides are identical, each having a lower guide flange 21 and upper guide flange 22 joined by a vertical web 23 (FIG. 9). The top of each slide is formed by a top flange 24 which is wider than the guide flanges and is spaced above the upper guide flange enough to receive the inwardly directed leg elements 25, which define the central slots 14 and 14a. Thus, the top flange 24 and the upper guide flange 22 together define oppositely facing guideways 26 which cooperate with the legs 25 to support and guide the slides 20 (FIGS. 5 and 9).

The width of the upper and lower guides is such as to closely fit between the sides of the beam and, thus, guide and stabilize the slides as they are moved along the beam. These flanges particularly control and prevent fore and aft rocking movement of the slides.

Figure 5:
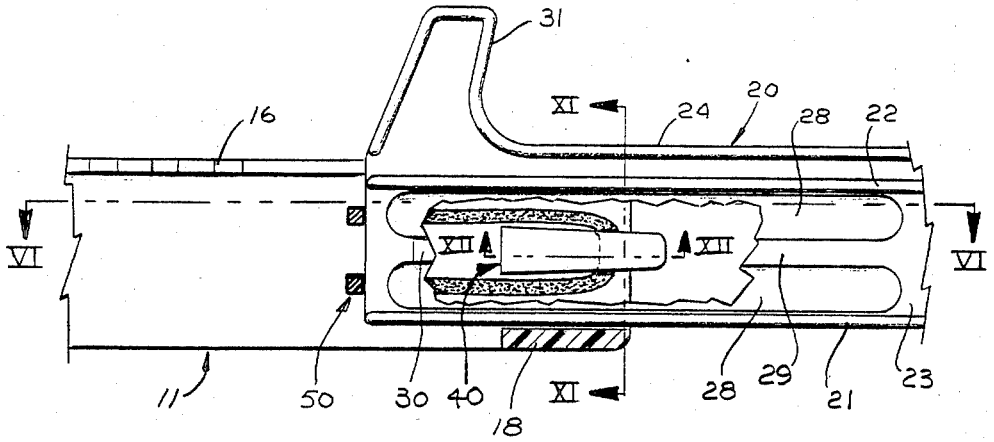
FIG. 5 is an enlarged, fragmentary, partially broken view of the end of the hanger body with the arm in extended position.

The vertical web 23 of each slide has a pair of shallow recesses 28 in each face extending lengthwise of the web a portion of its length (FIGS. 5 and 9). The recesses are separated by a rib 29, the inner end of which has an arrowhead-shaped portion 30 (FIGS. 6, 8, 9 and 10), the point of which is directed inwardly and serves as a spreader as will be explained subsequently.

Figure 15:
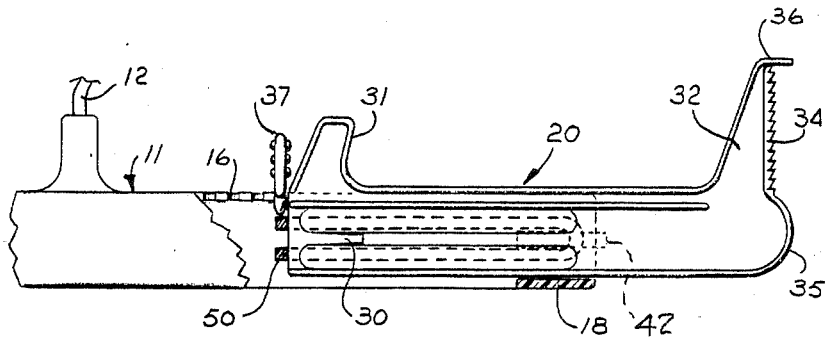
FIG. 15 is a fragmentary, partially broken, side elevation view illustrating the use of the stop.

The inner end of each slide has an upstanding hand grip 31 which is inclined upwardly and outwardly to provide a more positive handle for the operator (FIGS. 1 and 5). The outer end of each slide has an upwardly extending end member 32 having an outer face 33 designed to effect a positive grip on garment fabric against which it is pressed. The outer face can have both teeth 34 (FIG. 15) and a rounded protrusion 35 projecting beyond the teeth (FIGS. 1 and 15). At the top of the outer face 33, a projecting lip is provided to serve as a garment stop 36 to prevent garments from working their way off the hanger by upward movement. It also serves as a guide to properly position the garment's waistband on the end face 33.

As the slide 20 is molded, a stop 37 is molded integrally with it (FIG. 8) and later detached and used in the manner hereinafter described.

Figure 11:
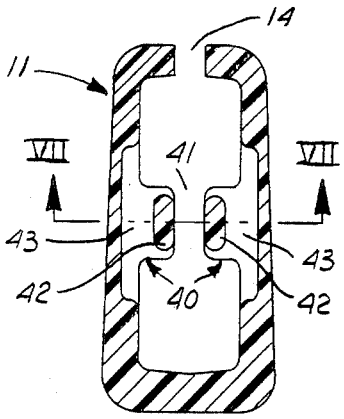
FIG. 11 is a sectional view taken along the plane XI—XI of FIG. 5 but omitting the slide.

At each of its ends the body member or beam 11 has a pair of inwardly extending bosses 40 substantially centered between the top and bottom of the beam (FIGS. 5, 6 and 11) and integral with the sidewalls of the beam. The bosses are aligned with the ribs 29 on the slides 20 and project from the side walls to leave a central passage 41 (FIG. 11) between them no wider than the thickness of the web of the slides at their central ribs. The bosses each have a finger 42 which projects beyond the end of the beam. Between each finger and the adjacent sidewall of the beam is a slot-like seat 43 for the elastic member used to bias the slides 20 or **20*a*** into extended position.

The main body or beam member 11 and the slides 20 and **20*a* can be molded of any suitable plastic material, such as polypropylene or styrene. It is entirely feasible to mold the beam member 11 of styrene and the slides 20, 20*a* of polypropylene. As will be explained subsequently, while these components must have sufficient rigidity to sustain the loads to be expected when used as garment hangers including heavy garments, it is necessary that the side walls of the beam in the area of the bosses 40** be capable of a limited degree of flexure to permit initial assembly of the hanger. The height of the beam must be such as to resist bending under the weight of the garments which is imposed at the ends of the slides. It must also be capable of resisting any tendency to bow fore or aft due to the compressive loads resulting from the slides moving out to firmly grip the garment. It is also necessary that the slides be so held that they do not rock fore and aft even when extended.

Figure 6:
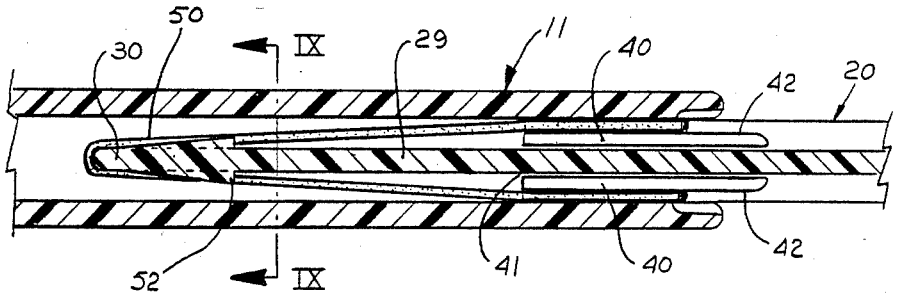
FIG. 6 is a fragmentary section view taken along the plane VI—VI of FIG. 5.
Figure 13:
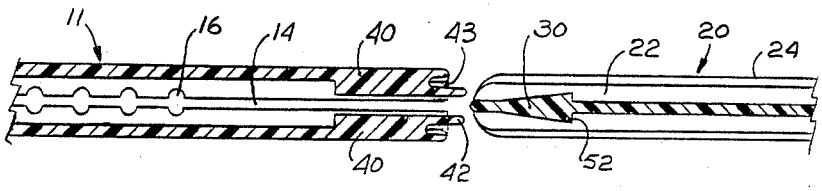
FIG. 13 is a view similar to FIG. 12 but showing the body and arm separated.
Figure 12:
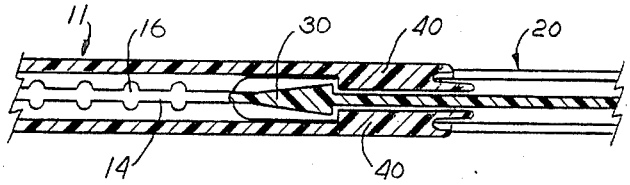
FIG. 12 is a fragmentary sectional view taken along the plane XII—XII of FIG. 5.
Figure 14:
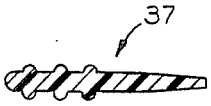
FIG. 14 is a sectional elevation view taken along the plane XIV—XIV of FIG. 8.
Figure 16:
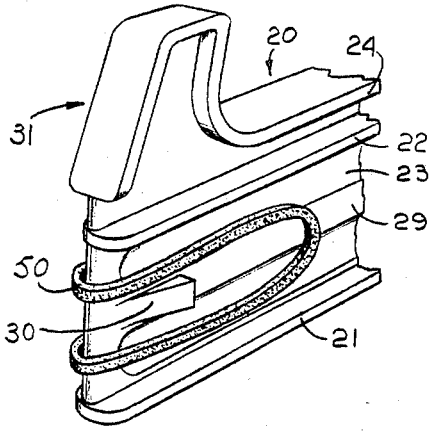
FIG. 16 is a fragmentary oblique view of the end of the slide readied for assembly with the hanger body.

To assemble the hanger, an endless band member 50 of elastic, such as a rubber band or band of a material of similar characteristics is placed around the inner end of each slide 20 and **20*a* with the end loops of the band on each side of the slide (FIG. 16). The sides of the band are separated sufficiently to pass above and below the head 30 and the bosses 40. With the band 50 so positioned, the end of the slide is inserted into the end of the body member or beam 11 as indicated in FIGS. 12 and 13 (which, for the sake of clarity, omit illustration of the band). As the arrowhead-like end 30 of the slide passes through the central passage 41 between the bosses 40, the head 30 spreads the sides of the beam. Once having passed inwardly beyond the bosses, the sides return to their original position, thus, trapping the end 30 and the slide because the blunt outer end 52 of the head 30 serves as a stop against the inner ends of the bosses (FIG. 6). It is for this reason that the walls of the beam 11** must have a limited degree of flexure capability.

By the time the head 30 has passed beyond the inner ends of the bosses 40, the closed ends of the elastic band will reach the outer end of the bosses where the operator will guide the band to seat in the band seats 43 on each side of the slide. Once both slides have been installed as indicated, the hanger is ready for use. Preferably, the length of the elastic bands is such that when the slides 20 or **20*a*** are fully extended, the bands are stretched and thereby apply some outward bias to the slides. Any inward movement of the slides after the elastic bands are in place will tension the bands and apply increased outwardly directed bias to the slides.

To use the hanger, the operator places the thumb and fingers of one hand around the hand grips 31 of both slides and closes the hand to draw the grips together. With the hanger thus retracted, the operator inserts the hanger in the waistband of the garment and relaxes the grip to allow the elastic bands to extend the slides until they firmly engage the garment. Preferably, this is a gradual release affording the operator an opportunity to use the other hand to adjust the garment so that the top of the waistband seats against the stops 36. With the garment properly positioned against the ends of the slides, the combination of the gripping power of the teeth 34 and the protrusions 35 will positively hold the garment from sliding off the hanger under its weight even though the conditions of usage are severe such as occur in long distance transport.

At the retail level, the sales clerk can exhibit the garment by holding the hanger by the hook 12. To release the hanger, all the clerk has to do is to squeeze the handles 31 together.

The stops 37 are provided to prevent possible retraction of the slides during transport or long periods of storage such as in a warehouse during which fatiguing of the elastic member may occur. Thus, when the garment is ready for shipment or storage, the stop 37 is separated from the slide and inserted in the proper notches 16 to prevent the slides from contracting. Preferably, the stops are so positioned that the slides exert constant pressure against them (FIG. 15). When the stops are not required, they can be stored in the two notches closest to the center of the hanger.

Having described the invention and its operation, it will be recognized that other modifications can be made without departing from the principles of the invention. Such modifications are to be considered as included in the hereinafter appended claims, unless these claims, by their language, expressly state otherwise.

I claim:

1. A garment hanger having an elongated, hollow beam-like body member and a pair of slide elements one slidably and telescopically mounted in each end of said body member and forming the ends of said hanger, said body member having a central support hook and mounting means therefor; the upper face of said body member defining a central narrow slot extending from each end to adjacent said mounting means, said slot being defined by inwardly directed rims of said body member; said slide elements adjacent their upper edges having vertically spaced flanges defining a track for receiving said rims and guiding said slide elements as they are moved lengthwise of said body member; elastic tension members and means securing one end of each of said tension members to said body member adjacent each of the open ends of said body member, said tension members each engaging the inner end of one of said slide elements for stretching said tension members as said slide elements are moved toward the center of said hanger, interengaging means at the inner end of each of said slide elements and adjacent each of the opposite ends of said body member for limiting outward movement of said slide elements; the outer ends of each of said slide elements having an outer face shaped to engage and grip the inside surface of the waistband of a garment surrounding the hanger.

2. A garment hanger as described in claim 1 wherein at least that portion of the lower face of said body member adjacent each of said open ends is closed to provide vertical support for said slide elements.

3. A garment hanger as described in claim 2 wherein said slide elements each have a vertical height approximately that of the body member and along their lower edge have a lower guide flange with a width substantially that of the spacing between the sides of the body member for providing guidance to the slide elements as they are moved lengthwise of the body member.

4. A garment hanger having an elongated, hollow beam-like body member and a pair of slide elements one slidably and telescopically mounted in each end of said body member and forming the ends of said hanger, said body member having a central support hook and mounting means therefor; said body member at each end having a pair of bosses, said bosses of each pair extending inwardly from the sides of said body member and spaced to form a passage therebetween through which a respective one of said slide elements can be moved; a pair of elastic tension members, one for each of said slide elements; each of said tension members engaging the inner end of a slide element and being secured to said bosses for urging said slide element into extended position; the inner end of each of said slide elements having a head portion adapted to engage said bosses for limiting outward movement of said slides.

5. A garment hanger as described in claim 4 wherein said each of said tension members is an endless loop.

6. A garment hanger as described in claim 5 wherein each of said tension members extends around the inner end of one of said slide elements and the closed ends of the loop are anchored to said bosses.

7. A garment hanger as described in claim 6 wherein each of said bosses has an outwardly directed hook member forming a socket, said closed ends of said tension members being seated in said sockets.

8. A garment hanger as described in claim 7 wherein said hook members each include a finger adjacent the side of said slide element and projecting outwardly beyond the end of said body member as a guide for seating the closed ends of the tension members in the sockets.

9. A garment hanger as described in claim 4 wherein said head portion has a pair of outwardly inclined surfaces arranged in arrowhead shape in cross section forming a pair of shoulders facing toward said bosses and vertically aligned therewith for separating said bosses when said slide elements are first assembled to said body member and said shoulders serving as the boss engaging portion to prevent separation of the slide elements from the body member.

10. A garment hanger as described in claim 9 wherein said head and said bosses are located substantially midway between the top and bottom of said body member and slide elements.

11. A garment hanger as described in claim 4 wherein the said body member has a plurality of spaced openings in its upper surface; a pair of stops, each having a support post shaped to seat in one of said openings and detachably secure the stop to the body member to prevent inward movement of the adjacent slide element should the resistance of the garment start to overcome the resistance of the tension member.

12. A garment hanger having an elongated, hollow beam-like body member and a pair of slide elements one slidably and telescopically mounted in each end of said body member and forming the ends of said hanger, said body member having a central support hook and mounting means therefor; web means joining the sides of said body member adjacent said hook mounting means; means connecting the sides of said beam-like body member adjacent each of its ends for supporting said slide elements from beneath; the top of said body member having inwardly directed leg members defining a central slot extending lengthwise of said body member from each of its ends to a point adjacent said hook mounting means; said slide elements each having a pair of flanges extending from both the front and back faces thereof, the flanges of each pair being vertically spaced to form a channel to receive and seat closely about said legs for supporting and guiding said slide elements; said slide elements each having an upwardly extending hand grip at its inner end extending through a corresponding one of said slots; a pair of resilient means, each engaging one of said slide elements and urging it into extended position; interengaging means at the inner end of each of said slide members and adjacent each of the opposite ends of said body member for limiting outward movement of said slide members; the outer ends of said slide elements having garment gripping surfaces.

13. A garment hanger as described in claim 12 wherein each of said slide elements adjacent its lower edge has a third flange extending from both faces thereof of a width to fit closely between the sides of said body member.

* * * * *